US008281775B1

(12) United States Patent
Larson

(10) Patent No.: US 8,281,775 B1
(45) Date of Patent: Oct. 9, 2012

(54) SYNCHRONIZED COMPOUND ARCHERY BOW

(75) Inventor: Marlow W. Larson, Ogden, UT (US)

(73) Assignee: Larson Archery Company, Ogden, UT (US)

( * ) Notice: Subject to any disclaimer, the term of this patent is extended or adjusted under 35 U.S.C. 154(b) by 0 days.

(21) Appl. No.: 13/078,841

(22) Filed: Apr. 1, 2011

Related U.S. Application Data

(63) Continuation of application No. 12/009,995, filed on Jan. 23, 2008, which is a continuation of application No. 11/241,030, filed on Sep. 30, 2005, now Pat. No. 7,441,555.

(51) Int. Cl.
*F41B 5/10* (2006.01)

(52) U.S. Cl. ..... 124/25.6; 124/900

(58) Field of Classification Search ..... 124/25, 124/25.6, 900
See application file for complete search history.

(56) References Cited

U.S. PATENT DOCUMENTS

| | | | | |
|---|---|---|---|---|
| 3,486,495 | A | 12/1969 | Allen | |
| 3,990,425 | A | 11/1976 | Ketchum | |
| 4,368,718 | A | 1/1983 | Simonds et al. | |
| 4,461,267 | A | 7/1984 | Simonds et al. | |
| 4,748,962 | A | 6/1988 | Larson | |
| 4,774,927 | A | 10/1988 | Larson | |
| 4,967,721 | A | 11/1990 | Larson | |
| 5,368,006 | A | 11/1994 | McPherson | |
| 5,505,185 | A | 4/1996 | Miller | |
| 5,782,229 | A | 7/1998 | Evans et al. | |
| 5,791,322 | A | 8/1998 | McPherson | |
| 5,934,265 | A | 8/1999 | Darlington | |
| 5,975,067 | A | 11/1999 | Strother | |
| 6,082,347 | A | 7/2000 | Darlington | |
| 6,112,732 | A | 9/2000 | Larson | |
| 6,247,466 | B1 | 6/2001 | McPherson | |
| 6,415,780 | B1 | 7/2002 | Proctor | |
| 6,443,139 | B1 * | 9/2002 | McPherson | 124/25.6 |
| 6,516,790 | B1 | 2/2003 | Darlington | |
| 6,666,202 | B1 | 12/2003 | Darlington | |
| 6,688,295 | B1 | 2/2004 | Miller | |
| 6,763,818 | B2 | 7/2004 | Larson | |
| 6,990,970 | B1 | 1/2006 | Darlington | |
| 7,305,979 | B1 | 12/2007 | Yehle | |
| 7,441,555 | B1 | 10/2008 | Larson | |
| 2009/0188482 | A1 | 7/2009 | Strother | |
| 2009/0255520 | A1 | 10/2009 | Strother | |
| 2009/0288650 | A1 | 11/2009 | Batdorf | |
| 2009/0320816 | A1 | 12/2009 | Strother | |
| 2010/0051005 | A1 | 3/2010 | Wilson | |

* cited by examiner

*Primary Examiner* — John Ricci
(74) *Attorney, Agent, or Firm* — Brian C. Trask

(57) ABSTRACT

A rigging structure for a compound archery bow includes first and second pulley assemblies, pivotally mounted on axles at tips of corresponding first and second limbs of a compound bow and interconnected by cables. Each pulley assembly includes a dynamic synchronizing component, and the rigging preferably also includes structure adapted to avoid the usual leaning moment imposed upon the pulley assemblies by the cables of conventional riggings.

18 Claims, 5 Drawing Sheets

SYNCHRONIZED COMPOUND ARCHERY BOW

RELATED APPLICATIONS

This application is a continuation of commonly assigned U.S. patent application Ser. No. 12/009,995, filed Jan. 23, 2008, and titled "SYNCHRONIZED COMPOUND ARCHERY BOW," which is a continuation of and claims the benefit under 35 U.S.C. 120 of the filing date of commonly assigned U.S. patent application Ser. No. 11/241,030, filed Sep. 30, 2005, and titled "SYNCHRONIZED COMPOUND ARCHERY BOW," now U.S. Pat. No. 7,441,555.

BACKGROUND

1. Field of the Invention

This invention relates to compound archery bows. It is particularly directed to an improved rigging system for such bows.

2. State of the Art

Compound archery bows commonly carry assemblies of pulley members (usually called "eccentrics" or "cams") eccentrically mounted on axles in association with respective bow limbs. These limbs extend in opposite directions from a grip (usually comprising a central portion of a handle riser). The rigging for compound bows includes a bowstring trained around the pulley members of the system, the string being received by grooves or other functionally equivalent features at the perimeters of the pulleys. The eccentric pulley assemblies are conventionally mounted to rotate (pivot) on an axle within a notch at the distal end of the limb, or within a bracket structure carried by the limb tip. The eccentrics include one or more pivot holes substantially offset from center, whereby to provide for a reduction in the holding force felt at the nocking point of the bowstring, as the string is moved to its fully drawn condition.

Compound bows and various exemplary riggings, including pulley assemblies, are described by U.S. Pat. Nos. 3,486,495; 3,990,425; 4,368,718; 4,461,267; 4,748,962; 4,774,927; 4,967,721; and 6,763,818.

The rigging for compound bows typically includes cable segments, which may be end stretches extending from an integral bowstring. More often, however, the cable segments are separate elements, each connecting at one end, directly or indirectly, e.g., through structure associated with the pulley assembly, to a terminal end of the bowstring. The remaining (distal) ends of the cable segments are conventionally connected to the opposite bow limb or structure, such as the pivot axle mount of the pulley assembly carried by that limb. In any case, each cable segment includes one or two stretches oriented approximately parallel the bowstring. "Approximately parallel," is intentionally fluid in context, merely recognizing that the cable segments and bowstring all extend generally across, but out of contact with, the handle riser portion of the bow between the pulley assemblies, or other structure, carried by the respective bow limbs. All of the cable stretches are thus confined within a space defined by reference planes straddling the handle riser and containing the bowstring. The cable stretches are commonly positioned to one side of the bowstring to avoid interference with the nocking point of the bowstring. It is common practice to mount cable guard rods or other structures to the handle riser. These structures are positioned physically to hold the cables away from the plane of travel of the bowstring. Compound bows have sometimes been configured to position cables on opposite sides of a bowstring so that an arrow may be cast in the plane of the bowstring between cable stretches.

With a compound bow oriented in its normal position of use, it is conventional to consider the bow as being oriented vertically, and from the perspective of a user. Unless otherwise stated, the bows referred to in this disclosure are assumed to be in this "vertical" orientation. The handle riser is thus considered to have an "upper end," a "lower end" and a central grip portion. The limb extending from the upper end of the handle riser may be referred to as "a first limb" or the "upper limb," in either case terminating in an "upper limb tip." Corresponding terminology is applied to the "second limb," which extends from the lower end of the handle riser. The bowstring is assumed to travel in a plane ("operating plane") of travel between a fully drawn condition and braced or at rest condition. Cable stretches may be viewed as being positioned to the left or right of the plane of travel of the bowstring, recognizing that in some rigging systems, a cable stretch may be to one side of that plane of travel along the first limb and to the opposite side of that plane of travel as the stretch proceeds to its point of attachment at the second limb. The geometry of a compound bow inherently lacks bisymmetry with respect to the operating plane of the bowstring. The relative magnitudes of forces applied by the bowstring and cable stretches changes, often irregularly, as the nocking point is drawn or an arrow is launched. The variety of rigging configurations present in the field is explained in part by different approaches taken by bow designers with respect to the balancing of forces unevenly applied to limb tips, axles, limb mountings and other bow components by the cable stretches under actual use conditions.

A troublesome characteristic of the rigging systems offered by commercial compound bows is the inherently unequal application of force to opposite sides of the mounting axles of the pulley assemblies as the bowstring is drawn. As a general matter, riggings that position all of the cables to one side of the bowstring inevitably apply cable forces to the same side of the string groove. The assemblies thus tend to lean, tip, or twist with respect to the operating plane of the bowstring. Various terminal cable end configurations have been proposed to distribute the force load applied to the axles or limb tips in an effort to ameliorate this problem. One such configuration is that commonly referred to as a "yoke" or "Y harness." In that arrangement, the terminal, or anchor, end of a cable is divided into two strands, which extend to opposite sides of a pulley assembly, thereby evenly distributing the force applied by that cable to its respective attachment points.

Proper operation of a compound bow typically requires periodic "tuning;" that is, synchronization of the pulley members. The pulley assemblies must be synchronized in their rotation so that the mechanical advantages developed through the two assemblies change at the same rate and to the same degree. Over a period of use, for various reasons, including stretching of the bowstring, compound bows typically migrate out of tuned condition. Re-tuning of the bow requires time consuming and technically demanding adjustments of the rigging. A number of efforts have been made to modify the rigging of compound bows to overcome or reduce the tuning requirement of such bows. These efforts have had little practical success. The persistent need for tuning and re-tuning is believed to be a major impetus for the wide acceptance of single cam bows. Single cam bows are believed by most archers to require much less effort to keep in tune, although the performance of the single cam configuration is less desirable in other respects than is the performance of conventional compound bows.

U.S. Pat. No. 3,990,425 proposes a rigging system that cross-couples the pulley assembles of a compound bow so that they are constrained to move in unison, thereby providing a self-tuning function to the bow. To the extent that this expedient has been incorporated into commercial compound bows, the riggings have tended to exacerbate the inherent characteristic of pulley assemblies to twist (or lean) on their axle mounts. The riggings employed to date in cross-coupled bows apply cable force to the limb tips in a fashion that imparts a twisting moment to the mounting axles of the pulley assemblies. The '425 patent discloses pulley assemblies in which all of the working grooves are circular and in which cross coupling is accomplished through an anchoring arrangement which inherently imparts a leaning moment to the pulley assemblies. Specifically, the cables are all disposed to one side of the bowstring.

BRIEF SUMMARY OF THE INVENTION

This invention provides a rigging system comprising first and second pulley assemblies, mounted to pivot on axles located at the tips of corresponding first and second limbs of a compound bow constructed in generally conventional fashion. Each assembly includes a string pulley component with a peripheral string groove. The string pulley components of the respective assemblies are either identical or mirror images of each other in configuration. They may be of various cross sectional configuration, but from an operational perspective, are desirably non-circular. They may be mounted concentrically; that is, to pivot around their geometric centers, but are preferably mounted eccentrically; that is, to pivot around respective axes displaced from their geometric centers. Opposite ends of a bowstring are connected directly to the respective pulley assemblies such that, at rest condition of the bow, the peripheral string grooves are substantially occupied by wrapped bowstring. The term "groove" should be understood to include any structure capable of wrapping or otherwise spooling a length of bowstring or cable. The term "bowstring" refers to the flexible line component of the rigging that contains the nocking point and also wraps around the string pulley components of the respective pulley assemblies. It is recognized that in practice, the portions of the bowstring that wrap around the string pulley components may actually comprise separate cable segments extending from a central string segment containing the nocking point.

A cable pulley component, having a peripheral cable uptake grove is disposed beside, usually closely adjacent, the string pulley of each assembly. These components are desirably minor images of each other, and may also be of various cross sectional shape, usually non-circular. In practice, preferred pulley assemblies are constructed with non-circular string and cable grooves, the working portions of which are out of registration with each other. A dynamic synchronizing anchor component is also included in operable association with, typically as an integral component, each pulley assembly. The rigging further includes stabilizing means structured and arranged to distribute the application of forces through the cables to opposite sides of the pulley assembly, thereby to reduce, to a tolerable magnitude, the increased leaning moment typically applied to the pulley assemblies of compound bows as the bowstring is drawn.

The rigging of this invention includes first and second synchronizing cable segments, each of which includes a first (take-up) end and a second (synchronizing) end. The first synchronizing cable segment is anchored to a first one of the pulley assemblies in position to wrap onto the peripheral cable take-up groove (or functionally equivalent structure) of that assembly. The opposite (synchronizing) end of the first cable segment is anchored to the dynamic synchronizing anchor component of the other pulley assembly. The second synchronizing cable segment is attached to the second pulley assembly in position to wrap into the peripheral cable up-take groove of that assembly. The opposite end of the second cable segment is anchored to the dynamic synchronizing component of the first pulley assembly.

The entire rigging is thus constructed and arranged such that as the bowstring is pulled, its opposite ends (or cable segments attached to those ends) unwrap from the peripheral string grooves of the assemblies. Concurrently, the peripheral cable grooves (or functionally equivalent structure) of the assemblies take up (or wrap) portions of the first ends of the respective synchronizing cables. According to the presently preferred embodiments of this invention, relatively small lengths of the opposite (synchronizing) ends of the synchronizing cables are released from the synchronizing elements of the respective pulley assemblies as relatively longer lengths of the take-up ends are wrapped onto the cable up-take grooves of the respective opposite pulley assemblies. Of course, these relationships are subject to adjustment as required to obtain preferred force draw characteristics for a particular bow.

The pulley assemblies may be structured with sufficient width to permit passage of a launched arrow between the cables, without the use of a cable guard. In certain embodiments, however, cable-spreading structure is positioned between the cable segments located on opposite sides of the bowstring. Such cable spreading structure may be mounted to extend from the handle riser to between cable stretches located to the right and left of the bowstring. Certain embodiments of the pulley assemblies, particularly those that position all of the cables to one side of the bowstring, are quite narrow, however. Use of a cable guard is generally preferred in those arrangements.

The dynamic synchronizing anchor components of this invention may take various structural forms, provided they perform the function of providing a dynamic connection of a synchronizing cable segment to a pulley assembly. In the context of this disclosure, a "dynamic" connection is one that operates to change the length of the synchronizing cable as the nocking point is drawn, (ignoring the simultaneous change in length effected by wrapping of the take-up end of that cable onto a take-up groove. A typical such anchor component permits a portion of the cable segment to pay out from (or retrieve into) a pulley assembly as the bowstring is pulled. This arrangement is in direct contrast to the conventional practice of connecting the terminal end of a cable segment statically to the limb tip opposite the working surface (typically, a cable groove) operably associated with that cable segment. Some such connections comprise a terminal cable loop around the mounting axle of a pulley assembly. While the axle may turn within the loop in some such arrangements, the connection is nevertheless regarded as "static" because the cable segment is not changed in length by virtue of that connection as the bowstring is drawn.

To avoid duplication of explanation, this disclosure focuses on embodiments in which the synchronizing anchor components operate to pay out cable as the bowstring is drawn. It is recognized, however, that these components may alternatively be structured to retrieve cable as the bowstring is drawn. For example, simply reversing the direction of wrap on a spooling surface results in wrapping rather than unwrapping a synchronizing cable. Either mode of operation effects an operable interaction of the synchronizing cable with the synchronizing component, thereby inherently synchronizing the rotation of the respective pulley assemblies.

While more elaborate structures, including biasing mechanisms indirectly connecting the synchronizing end of a cable segment to the pulley assembly, can be envisioned, a simple small diameter drum, pulley or equivalent spooling member has been found to be adequate in practice to serve as a dynamic anchor. According to a typical embodiment, each dynamic anchor pulley is included as an integral portion of its pulley assembly. The spooling surface or groove of a dynamic anchor may be either concentric or eccentric with respect to the mounting axle of the pulley assembly In any case, the working portions of the respective spooling surfaces (or equivalent pay out devices) must be synchronized; that is, release practically identical lengths of synchronizing cable for any drawn distance of the bowstring. The synchronizing end of a synchronizing cable segment may thus be wrapped around the perimeter of an anchor pulley, or equivalent spooling structure, terminating in an attachment to the pulley assembly itself. Synchronization of the spooling surfaces is less challenging if those surfaces (or grooves) are concentric circular with respect to the pivot axles of the pulley assemblies. Nevertheless non-circular spooling surfaces may be preferred in certain instances to achieve particular shooting characteristics for a bow.

Unlike the cross coupling arrangement suggested by the '425 patent, the dynamic anchoring system of certain embodiments of this invention is associated with stabilization means for redistributing the forces applied to opposite sides of the pulley assemblies at all rest and drawn positions of the bowstring. One such means is to mount duplicate synchronizing anchor components on opposite sides of each pulley assembly. The synchronizing ends of each cable may then be attached through a "Y harness," or equivalent force dividing structure, to both of the duplicate components, thereby evenly distributing the cable tension forces at that end of the cable to opposite sides of the pulley assembly. This arrangement assures that approximately half of the force applied by the synchronizing end of each cable is applied to the pulley assembly at the side of the assembly opposite the string groove from the take-up cable groove. According to other specific embodiments, duplicating the cable pulley component in similar fashion similarly divides the force applied by the take-up end of the cable. The total force applied by the synchronizing cables is thereby applied approximately evenly to both sides of the pulley assembly, with respect to the string groove.

Alternatively, the working portions of the cable grooves and an opposing anchor spooling groove of the rigging may be arranged with respect to each other and interconnected to ensure that the forces of the synchronizing cables are applied approximately evenly to both the left side and the right side of each pulley assembly. This distribution of forces may be achieved, for example, by positioning two synchronizing cables approximately parallel and on opposite sides of the bowstring, preferably equidistantly spaced from the bowstring, as taught by U.S. Pat. No. 6,763,818 A parallel arrangement of this kind requires that the left-to-right sequence of the upper pulley assembly components be reversed for the lower pulley assembly. This arrangement permits a wide spacing of individual pulley assembly components, and is thus especially suitable for compound bows in which it is intended for an arrow to be launched between the cables. Another practical embodiment of the invention arranges one synchronizing cable to extend from the cable take-up groove at the left side of a first pulley assembly, across the handle riser of the bow to the anchor spooling surface at the right side of a second pulley assembly. The other synchronizing cable is connected to extend from the cable take-up groove at the right side of the second pulley assembly, across the handle riser of the bow to the anchor spooling surface at the left side of the first pulley assembly. In this construction, each cable crosses the handle riser of the bow in both the vertical and horizontal directions.

Certain preferred embodiments of the invention provide rigging for a compound archery bow, which includes first and second pulley assemblies. Such pulley assemblies are typically mounted to pivot on respective axles at tips of corresponding first and second limbs of a compound bow. Furthermore, each pulley assembly desirably includes: a string pulley component with a non-circular peripheral string groove; a cable pulley component with a non-circular peripheral cable take-up groove; and a dynamic synchronizing component. The rigging includes a bowstring with opposite ends connected to the first and second pulley assemblies such that, at rest condition of the bow, the peripheral string grooves are substantially occupied by wrapped bowstring, or by cable extensions from the bow string. The rigging also includes first and second cable segments. The first cable segment is arranged to extend from the entry of the peripheral cable take-up groove of the first pulley assembly to the synchronization component of the second pulley assembly. The second cable segment is arranged to extend from the entry of the peripheral cable take-up groove of the second pulley assembly to the synchronization component of the first pulley assembly. The first and second pulley assemblies are structured and arranged such that as the bowstring is pulled from its rest position towards its drawn position, respective first ends of the first and second cable segments wrap onto the peripheral cable take-up grooves of the first and second pulley assemblies, respectively. Additionally, respective second ends of said first and second cable segments are adjusted in length by operation of the dynamic synchronization components of the second and first pulley assemblies, respectively.

The rigging of certain embodiments of the invention desirably also includes stabilization means for distributing at least about one-half of the force applied by the second end of each first and second cable segment to the side, of each respective pulley assembly, opposite the string groove from the cable take-up groove. By symmetry, the tensile force in the first cable segment of a bow strung according to principles of the invention is at least substantially equal to the tensile force in the second cable segment (in an ideal situation, the tensile force in each cable has the same numerical value).

A first exemplary embodiment includes stabilization means structured and arranged to direct all of the force applied by the second end of each first and second cable segment to the side, of each respective pulley assembly, that is disposed opposite the string pulley component from the cable pulley component. The left to right sequence of the first exemplary embodiment's first pulley assembly is: cable pulley component, string pulley component, and dynamic synchronizing component; and the left to right sequence of its second pulley assembly is: dynamic synchronizing component, string pulley component, and cable pulley component. In such an arrangement, a first end of one cable applies a load "F" to the peripheral cable take-up groove (or component) disposed on one side of the string pulley component. Simultaneously, the second end of the other cable applies virtually the same load "F" to the dynamic synchronization component disposed on the other side of the string pulley component. The respective pulley assemblies of the first exemplary embodiment are stabilized by a structural arrangement that applies substantially equal loads "F" on opposite sides of the string pulley component.

Embodiments of the invention may be constructed such that each of the pulley assemblies includes a first cable pulley component disposed on the right side of a string pulley component and a second cable pulley component disposed on the left side of that string pulley component. In such case, a first cable segment extends through a Y harness arrangement to the first and second cable pulley components of the first pulley assembly. Also, a second cable segment extends through a Y harness arrangement to the first and second cable pulley components of the second pulley assembly.

The dynamic synchronizing components each typically include a spooling surface arranged to turn with an associated string pulley. Such spooling surfaces may be arranged to unwind cable as the bowstring is pulled. Certain embodiments constructed according to principles of the invention also include respective spooling surfaces that are arranged to apply force approximately equally at opposite sides of the string pulley components of the first and second pulley assemblies. Other workable embodiments also include respective spooling surfaces that are arranged to apply force approximately equally at opposite sides of the string pulley components of each of the first and second pulley assemblies. The latter arrangement constitutes a second exemplary stabilization means for distributing at least about one-half of the force applied by the second end of each first and second cable segment to the side, of each respective pulley assembly, opposite the string groove from the cable take-up groove.

Certain embodiments of the invention may be constructed such that the cable pulley component and the dynamic synchronizing component of each of the first and second pulley assemblies are spaced sufficiently to permit an arrow to be launched between the first and second cable segments. Certain of such embodiments provide an inherent spacing between respective cables sufficient to dispense with additional cable spreading structure.

BRIEF DESCRIPTION OF THE DRAWINGS

In the drawings, which illustrate what are currently considered to be the best modes for carrying out the invention.

DETAILED DESCRIPTION OF THE ILLUSTRATED EMBODIMENT(S)

Figure 1:
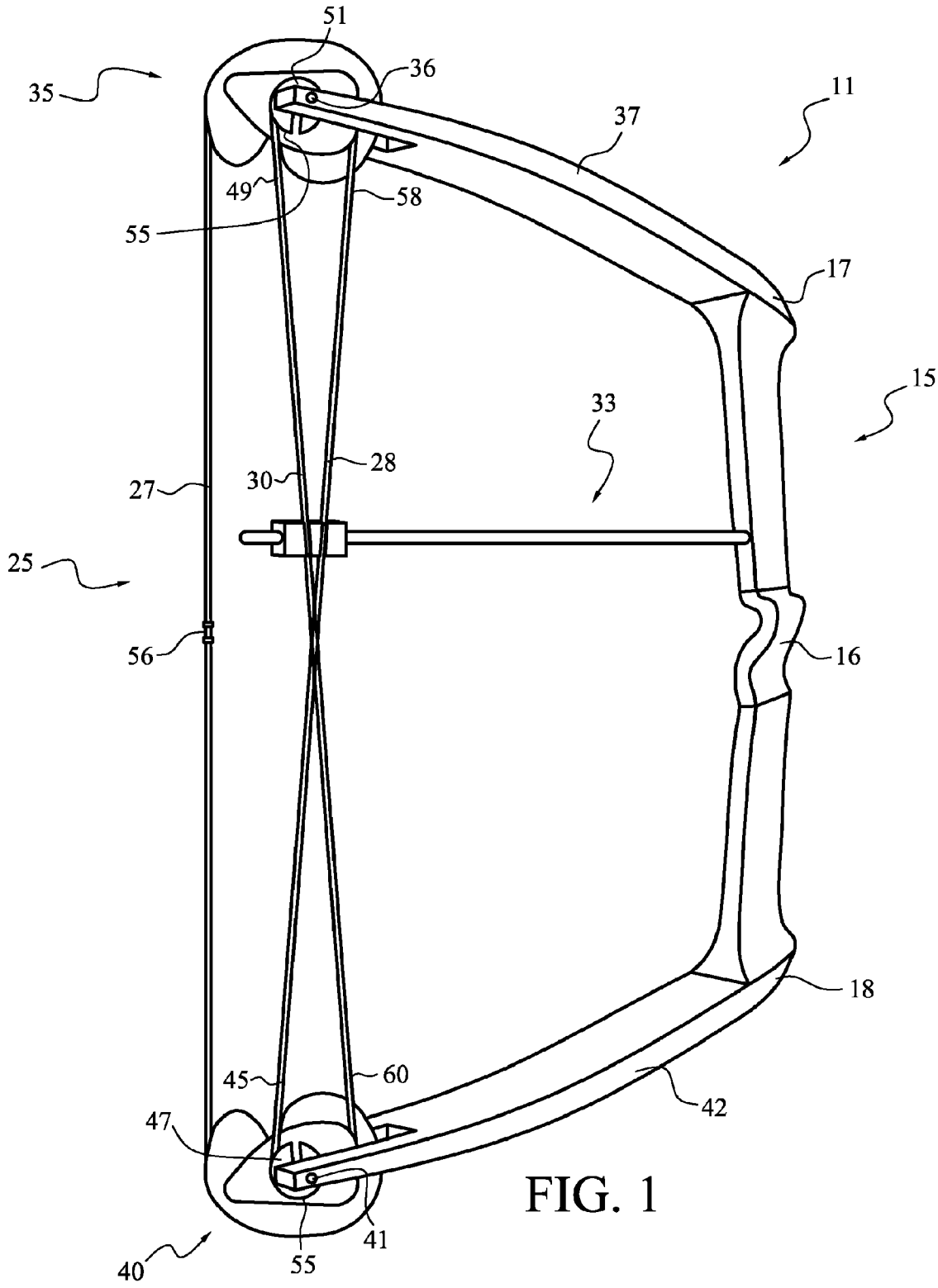
FIG. 1 is a pictorial side view of an archery bow of this invention in "braced" or relaxed condition.
Figure 1A:
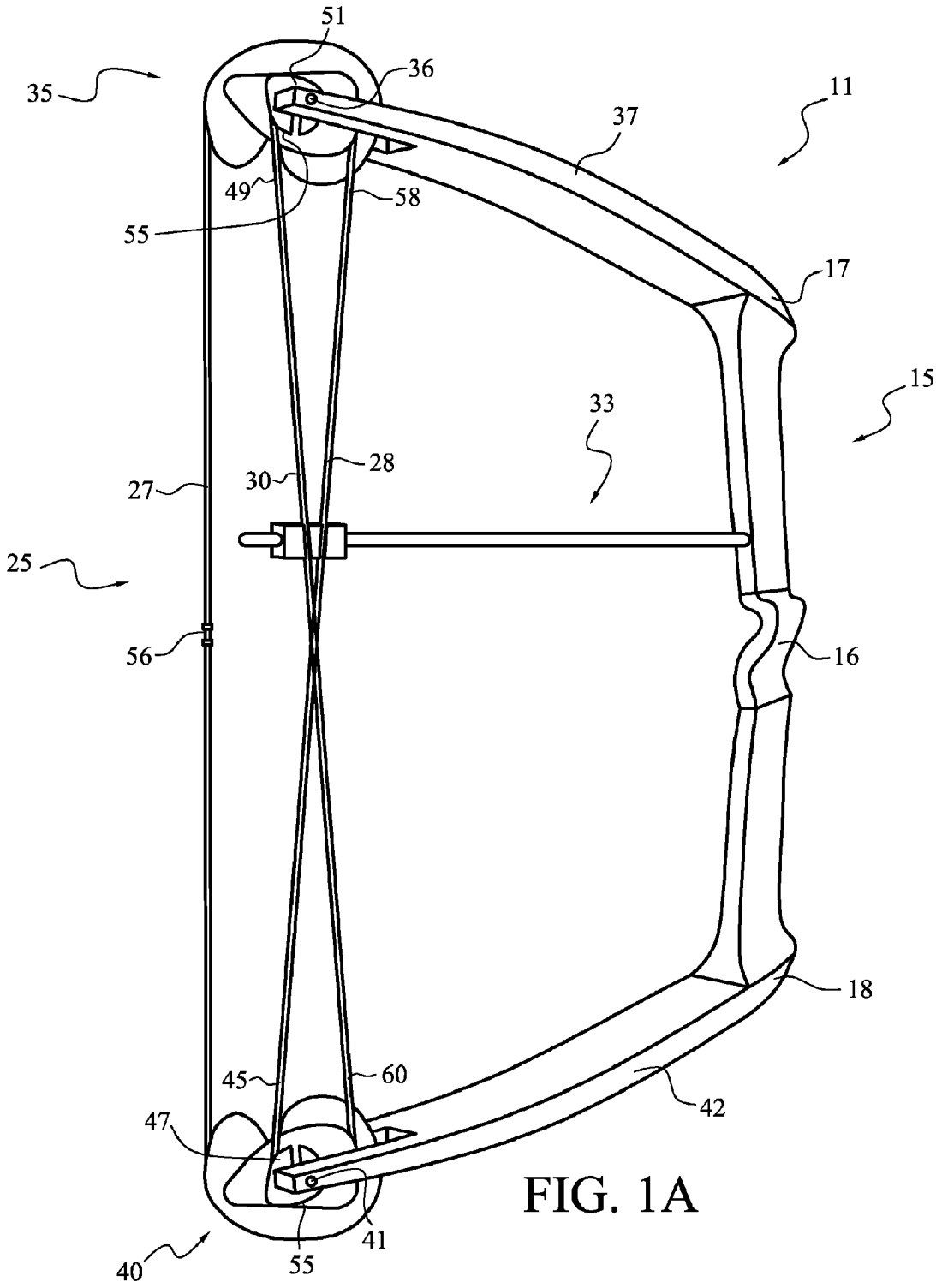
FIG. 1A is a pictorial side view of an archery bow of this invention in "braced" or relaxed condition, and illustrating synchronizing anchor components having exemplary non-circular spooling surfaces.

The compound bow, generally 11, illustrated by FIG. 1, is of generally conventional construction. It includes a handle riser component, generally 15, with a grip 16, an upper end 17 and a lower end 18. The rigging, generally 25, includes a bowstring 27, and two synchronizing cables 28, 30. The cables 28, 30 are held away from the operating plane of the bowstring 27 by a cable guard assembly, generally 33. An upper pulley assembly, generally 35, is mounted on a pivot axle 36 at the tip of an upper limb 37. A lower pulley assembly, generally 40 is similarly mounted on a pivot axle 41 at the tip of a lower limb 42. The rigging of pulley assembly 35 is arranged generally conventionally, except that the synchronizing end 45 of the cable 28 is coupled to the pulley assembly 40 through a synchronizing anchor component 47. Similarly, the synchronizing end 49 of the cable 30 is coupled to the pulley assembly 35 through a synchronizing anchor component 51. This "cross coupling" configuration is an important feature of this invention, in that it provides a self-tuning characteristic to the bow.

The synchronizing anchor components 47, 51 of the bow 11 illustrated by FIG. 1 each present a single spooling surface, 55 that is substantially occupied by cable when the bow 11 is at rest position. When the nocking point 56 is pulled to draw the bowstring 27, the spooling surfaces turn with the assemblies 35, 40, thereby permitting the cable ends 45, 49 to unwrap. As a consequence, the effective length of the cables 28, 30 increase in length (ignoring the simultaneous wrapping of take-up ends 58, 60 of these cables). It is apparent that both cables 28, 30 apply force only to the right side of the pulley assemblies 35, 40, thereby inducing those assemblies to lean in that direction.

Figure 2:
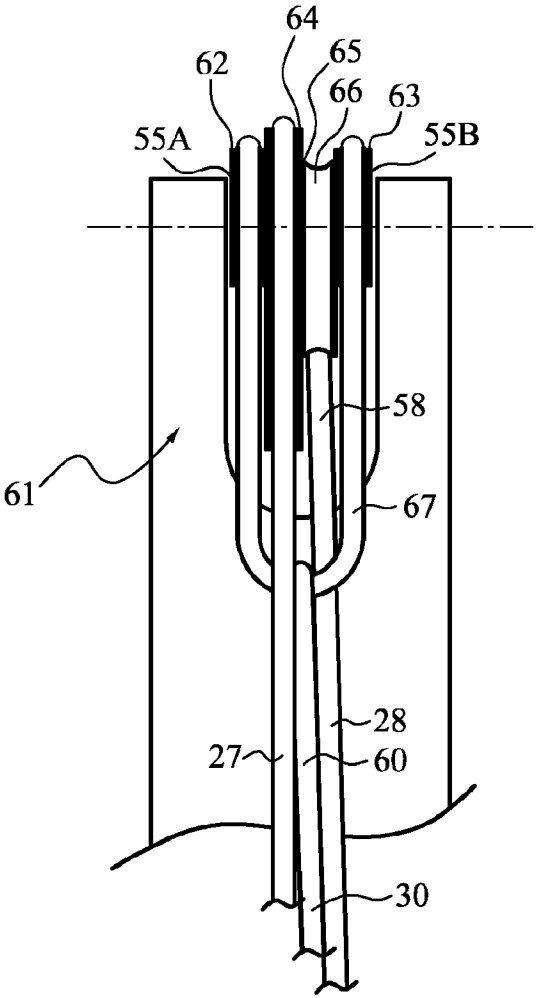
FIG. 2 is a fragmentary view in elevation, from the perspective of an archer drawing an arrow, of an pulley assembly of this invention within a rigging of this invention.

FIG. 2 illustrates an improved pulley assembly configuration, generally 61, in which two dynamic synchronizing anchor components 62, 63 straddle a string pulley component 64 and a cable pulley component 65. The bowstring 27 is wrapped around the string pulley 64 in the same manner as illustrated by FIG. 1. The take-up end 58 of the cable 28 is positioned to wrap onto peripheral take-up groove 66 of the cable pulley 65, also as illustrated by FIG. 1. The synchronizing end 60 of the cable 30, however, connects to a Y-harness 67, the respective ends of which wrap around the spooling surfaces 55A, 55B of the dynamic synchronizing anchor components 62, 63. By this means, half of the force applied by the synchronizing end 60 of cable 30 is applied to the pulley assembly 61 on the side (via dynamic anchor 55A) of the string pulley 64 opposite the cable pulley 65.

Figure 3:
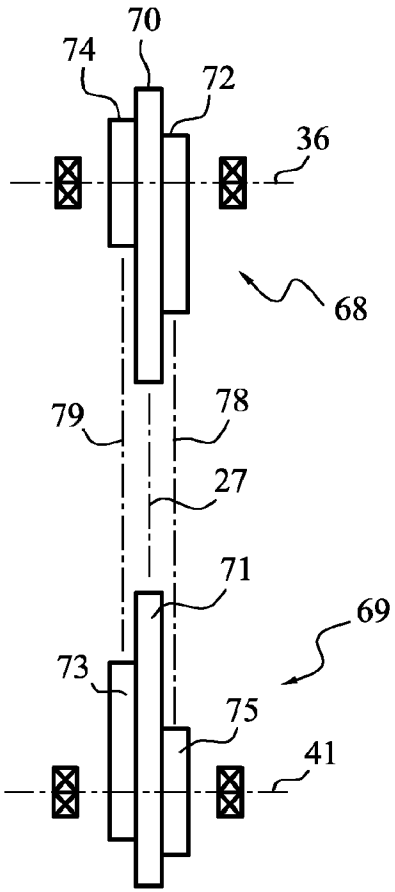
FIG. 3 is a diagrammatic representation of an alternative rigging arrangement of this invention.

FIG. 3 illustrates an alternative matched pair of pulley assemblies, generally 68, 69, mounted to pivot from opposed pivot axles, 36, 41 (FIG. 1). As illustrated, each assembly includes a string pulley component 70, 71, a cable pulley component 72, 73 and a relatively smaller pulley 74, 75 constituting a dynamic synchronizing anchor component. According to this embodiment, a bowstring 27 may be connected to the string pulleys 70, 71 in generally conventional fashion, as illustrated by FIG. 1. A first synchronizing cable 78 may then connect the take-up cable pulley component 72 of the first assembly 68 with the dynamic anchor component 75 of the second assembly 69. A second synchronizing cable 79 is similarly connected between the dynamic anchor 74 of the first assembly 68 and the cable pulley component 73 of the second assembly 69. In each instance, the take-up ends of the cables are attached to the respective cable pulley components generally as illustrated by FIG. 1. The synchronizing ends of the cables may be attached to the dynamic anchor components generally as illustrated by FIG. 1. Alternatively, the direction of wrap on the anchor components 74, 75 may be reversed so that these components take up rather than pay out cable when the bowstring is drawn.

Figure 4:
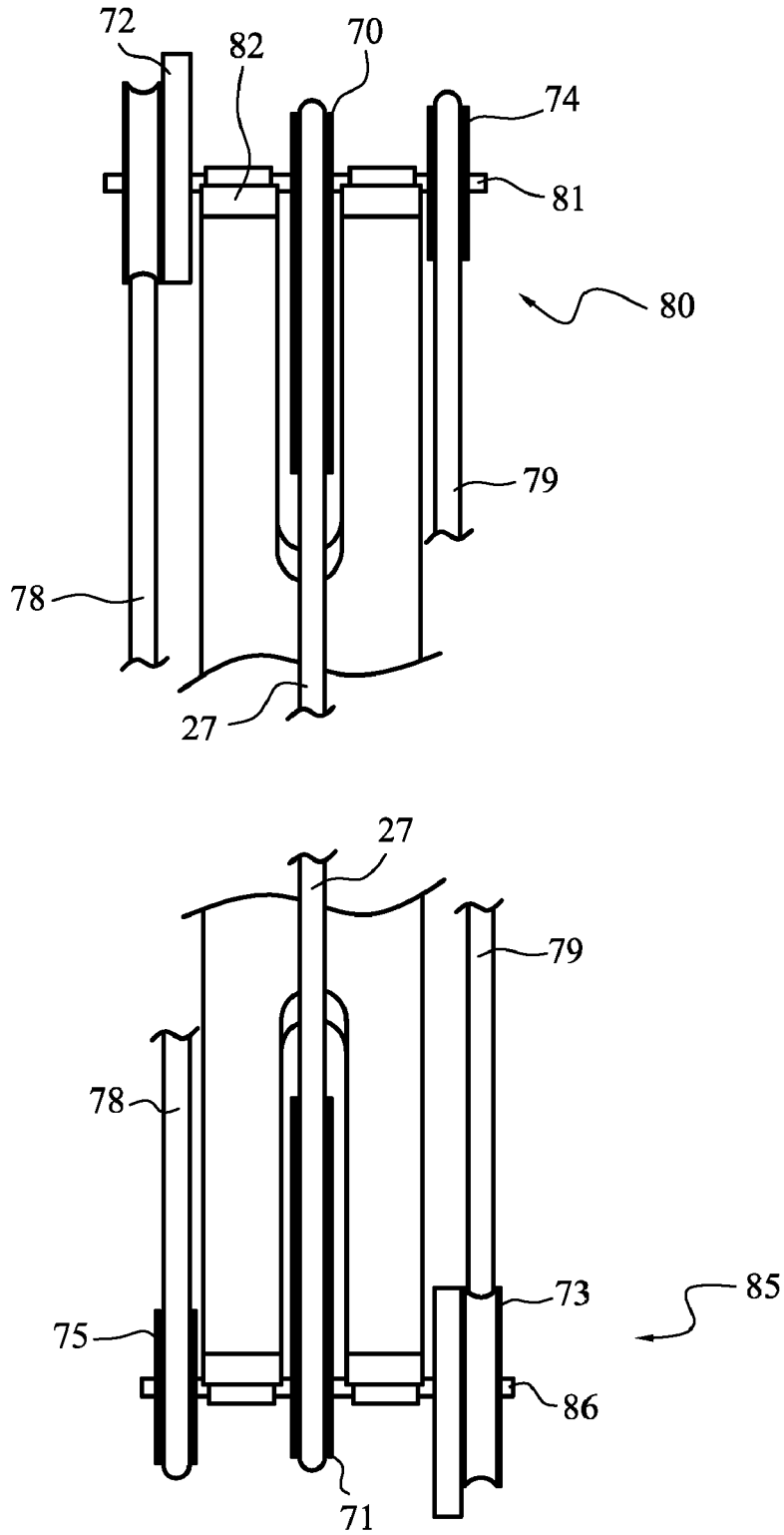
FIG. 4 is a fragmentary view in elevation, from a rear perspective similar to that illustrated in FIG. 2, showing a pair of pulley assemblies of alternative construction mounted to the limbs of a compound bow.

The alternative embodiment illustrated by FIG. 4 constitutes a "shoot-through" version of the embodiment illustrated by FIG. 3. That is, the cable pulley components 72, 73 are spaced apart from the string pulley components 70, 71, as are the dynamic stabilizing anchor components 74, 75. As illustrated, the upper pulley assembly, generally 80, includes a pivot axle 81 that spans the upper limb tip 82 such that the components 72, 74 are situated beyond the outside edges of the limb tip 82. The components of the lower assembly, generally 85, are similarly mounted to a pivot axle 86. The cables 78, 79 are thereby separated from the bowstring sufficiently to permit an arrow to be launched between them. Importantly, the forces applied by the respective cables 78, 79 are approximately the same (equal to each other) at all rest and drawn positions of the bowstring. Consequently, these forces are applied approximately equally at the left and right sides of each pivot axle 81, 86. Ideally, those separated forces are applied to each assembly 80, 85 approximately equidistantly with respect to the string pulleys 70, 71. In this arrangement, drawing the bowstring imparts practically no additional leaning tendency to either assembly 80, 85.

Figure 5:
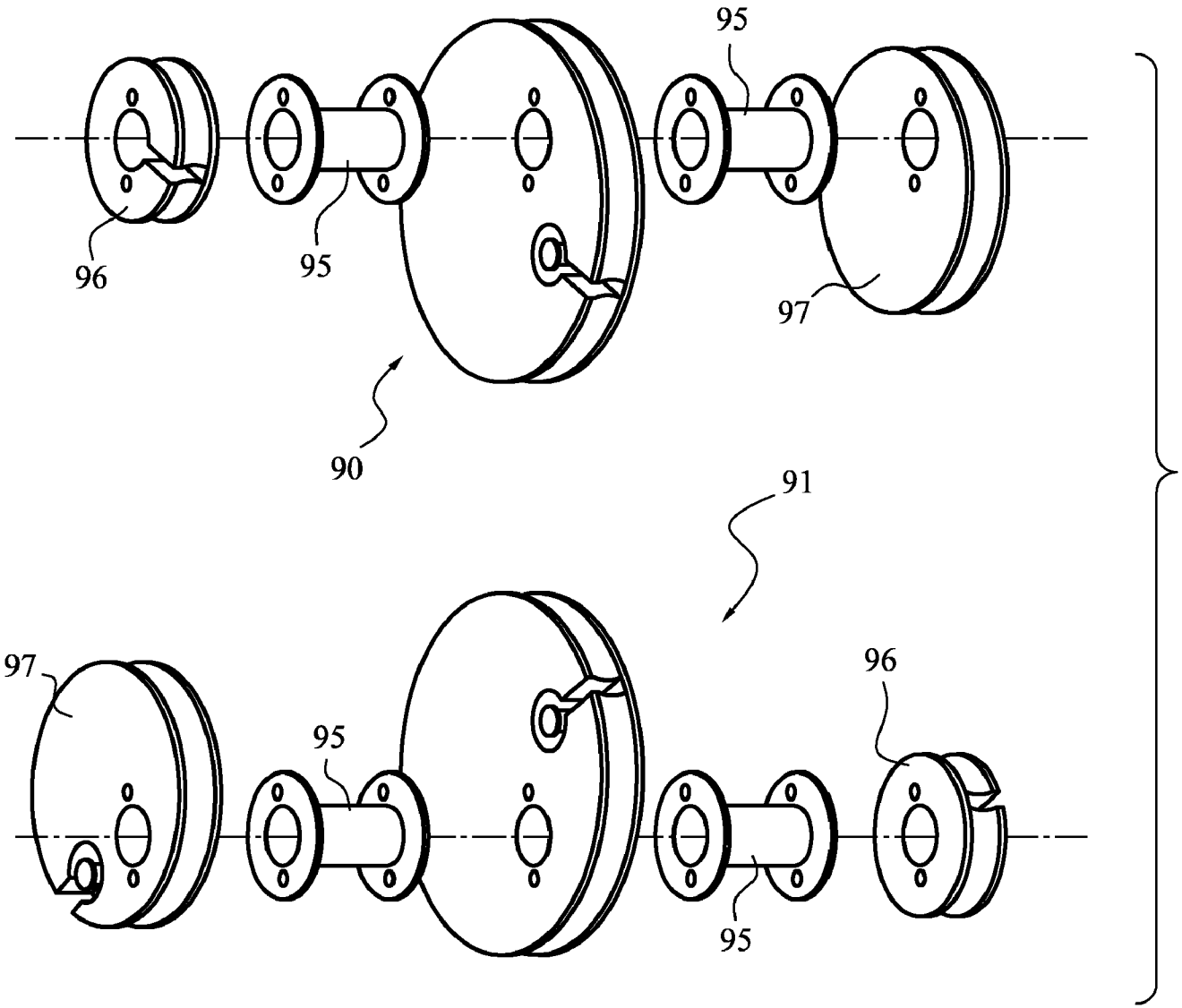
FIG. 5 is an exploded pictorial view of an alternative pulley assembly.

The alternative embodiment of FIG. 5 arranges the string pulley, cable pulley and dynamic anchor components of the pulley assemblies, generally 90, 91, in the same order and relative positions as described in connection with the embodiment illustrated in FIG. 4. The components of these assemblies 90, 91 may be included within a rigging generally as illustrated by FIG. 4, except that the pivot axles 81, 86 are replaced by hollow cylindrical flange members 95. These members may be connected as shown to provide a passageway, whereby a single continuous cable (not shown) may interconnect the dynamic anchor components 96 and the cable pulley components 97. The functions of the synchronizing cables 78, 79 (FIG. 4) are thereby provided to the resulting rigging.

What is claimed is:

1. A compound archery bow that includes: a handle having projecting limbs, a first pulley mounted on a first of said limbs for rotation around a first axis, a second pulley mounted on a second of said limbs for rotation around a second axis, and bow cable means including a bowstring cable extending from bowstring let-out grooves on said first and second pulleys, a first cable extending from a cable take-up groove on said first pulley to second cable let-out means on said second pulley, and a second cable extending from a cable take-up groove in said second pulley to first cable let-out means on said first pulley such that draw of said bowstring cable away from said handle lets out bowstring cable from said let-out grooves on said first and second pulleys, rotates said first and second pulleys around said axes, and lets out portions of said first and second cables from said first and second cable let-out means on said first and second pulleys, wherein at least one of said bowstring let-out grooves and/or at least one of said cable take-up grooves is non-circular and wherein at least one of said first and said second cable let out means comprises a non circular spooling surface.

2. Rigging for a compound archery bow comprising:

first and second pulley assemblies, mounted to pivot on respective axles at tips of corresponding first and second limbs of a compound bow; each assembly including:

a non-circular peripheral string groove;

a non-circular peripheral cable take-up groove; and a dynamic synchronizing component with a non-circular let out structure;

a bowstring with opposite ends connected to said first and second pulley assemblies such that, at rest condition of the bow, the peripheral string grooves are substantially occupied by wrapped bowstring;

a first cable segment, extending from the entry of the peripheral cable take-up groove of said first pulley assembly to the dynamic synchronizing component of said second pulley assembly; and a second cable segment, extending from the entry of the peripheral cable take-up groove of said second pulley assembly to the dynamic synchronizing component of said first pulley assembly;

said first and second pulley assemblies being structured and arranged such that as said bowstring is pulled from its said rest position towards its drawn position, respective first ends of said first and second cable segments wrap onto the peripheral cable take-up grooves of said first and second pulley assemblies, respectively, and respective second ends of said first and second cable segments operably interact with the dynamic synchronizing components of said second and first pulley assemblies, respectively.

3. Rigging according to claim 2, wherein said dynamic synchronizing components are structured and arranged to apply force approximately equally at opposite sides of the string pulley components of said first and second pulley assemblies.

4. Rigging according to claim 2, wherein said dynamic synchronizing components each comprise a spooling surface arranged to turn with an associated string pulley.

5. Rigging according to claim 4, wherein said spooling surfaces are arranged to unwind cable as said bowstring is pulled.

6. Rigging according to claim 5, wherein respective said spooling surfaces are arranged to apply force approximately equally at opposite sides of the string pulley components of said first and second pulley assemblies.

7. Rigging according to claim 2, wherein each of said pulley assemblies includes a first cable pulley component disposed on the right side of a string pulley component and a second cable pulley component disposed on the left side of that string pulley component;

said first cable segment extending through a Y harness arrangement to said first and second cable pulley components of said first pulley assembly; and said second cable segment extending through a Y harness arrangement to said first and second cable pulley components of said second pulley assembly.

8. Rigging for a compound archery bow comprising:

first and second pulley assemblies, mountable to pivot under cross-coupled condition on respective axles at tips of corresponding first and second limbs of a compound bow; each assembly including:

a peripheral string groove;

a peripheral cable take-up groove; and a dynamic synchronizing component comprising a non-circular spooling surface.

9. Rigging according to claim 8, wherein said peripheral string groove is non-circular in configuration.

10. Rigging according to claim 9, wherein said peripheral cable groove is non-circular in configuration.

11. Rigging according to claim 10, wherein said peripheral cable groove is non-circular in configuration, and said cable groove is out of registration with said string groove.

12. A pulley assembly mounted to pivot on an axle at a limb tip of a compound bow; said assembly including:

a non-circular peripheral string groove;

a non-circular peripheral cable take-up groove;

a dynamic synchronizing component with a non-circular let out structure; and anchor structure for a synchronizing cable, said anchor structure being disposed to hold an end of a synchronizing cable for letting out and taking up said synchronizing cable with respect to said non-circular let out structure, wherein:

said peripheral cable take-up groove and said synchronizing component are disposed on the same side of a plane containing said string groove.

13. A pulley assembly according to claim 12, wherein said dynamic synchronizing component comprises a spooling surface arranged to turn with an associated string groove.

14. A pulley assembly according to claim 13, wherein said spooling surface is arranged to unwind cable as said string groove unwinds bowstring.

15. Rigging for a compound archery bow comprising:

a pulley assembly adapted to pivot about an axis of rotation transverse a tip of a limb of said bow, said pulley assembly including:

a bowstring pulley sheave with a peripheral bowstring groove that is substantially occupied by bowstring at brace position;

a take-up pulley sheave portion with a peripheral cable take-up groove; and a dynamic synchronizer sheave portion;

said pulley assembly being structured to permit installation of said pulley assembly on said limb such that draw of an installed bowstring, away from said brace position and toward a full-draw position:

unwinds a portion of bowstring from said bowstring groove;

unwinds a synchronizing end portion associated with a first power cable from said dynamic synchronizer sheave portion; and winds a take up portion associated with a second power cable onto said cable take-up groove; wherein:

a bowstring plane, in which the centerline of said bowstring travels during draw of an arrow from said brace position, intersects said axis of rotation; and at said brace position before effect of a cable guard is applied, a first normal distance between said bowstring plane and a tension vector in a central stretch of said first power cable near said synchronizing end portion is no larger than a second normal distance between said bowstring plane and a tension vector in a central stretch of said second power cable near said take-up portion, said first distance and said second distance being measured in the same direction from said bowstring plane.

16. The rigging according to claim 15, wherein:

said bowstring pulley sheave is non-circular.

17. The rigging according to claim 15, wherein:

said take-up pulley sheave portion is non-circular.

18. The rigging according to claim 15, wherein:

said dynamic synchronizer sheave portion is non-circular.

* * * * *